US005645631A

United States Patent [19]

Koike et al.

[11] Patent Number: 5,645,631

[45] Date of Patent: Jul. 8, 1997

[54] CLOTH SUITABLE FOR INK-JET TEXTILE PRINTING AND INK-JET TEXTILE PRINTING METHOD

[75] Inventors: Shoji Koike; Tomoya Yamamoto, both of Yokohama, Japan

[73] Assignee: Canon Kabushiki Kaisha, Tokyo, Japan

[21] Appl. No.: 555,077

[22] Filed: Nov. 8, 1995

Related U.S. Application Data

[62] Division of Ser. No. 8,332, Jan. 25, 1993, Pat. No. 5,494,733.

[30] Foreign Application Priority Data

Jan. 27, 1992 [JP] Japan ..... 4-034064

[51] Int. Cl.[6] ..... C09D 11/02; B41J 3/407

[52] U.S. Cl. ..... 106/31.36; 347/106; 8/918; 8/920; 106/31.37; 106/31.43; 524/215

[58] Field of Search ..... 106/20 D; 347/106; 8/918

[56] References Cited

U.S. PATENT DOCUMENTS

| | | | |
|---|---|---|---|
| 4,702,742 | 10/1987 | Iwata et al. | 8/495 |
| 4,725,849 | 2/1988 | Koike et al. | 346/1.1 |
| 4,849,770 | 7/1989 | Koike et al. | 346/1.1 |
| 4,969,951 | 11/1990 | Koike et al. | 106/22 |
| 5,067,980 | 11/1991 | Koike et al. | 106/22 |
| 5,075,699 | 12/1991 | Koike et al. | 346/1.1 |
| 5,250,121 | 10/1993 | Yamamoto et al. . | |
| 5,396,275 | 3/1995 | Koike et al. | 347/101 |
| 5,468,553 | 11/1995 | Koike et al. . | |

FOREIGN PATENT DOCUMENTS

| | | |
|---|---|---|
| 54-59936 | 5/1979 | Japan . |
| 62-53492 | 3/1987 | Japan . |
| 3-46589 | 7/1991 | Japan . |

OTHER PUBLICATIONS

Derwent (WIPL) Abstract No. 87–239026 with respect to Japanese Patent Document No. 62162086 (Jul. 17, 1987).

Derwent (WIPL) Abstract No. 88–143766 with respect to Japanese Patent Document No. 63085188 (Apr. 15, 1988).

*Primary Examiner*—Margaret Einsmann

*Attorney, Agent, or Firm*—Fitzpatrick, Cella, Harper & Scinto

[57] ABSTRACT

A cloth suitable for ink-Jet textile printing is mainly composed of cellulosic fibers having an average fiber length of 25 to 60 mm, the cloth having a moisture regain of 13.5 to 108.5%. The cloth may be mainly composed of cellulosic fibers having an average thickness of 0.6 to 2.2 d and an average natural twist of 70 to 150/cm, or mainly composed of regenerated cellulosic fibers. In an ink-jet textile-printing method, a textile printing ink is imparted to the cloth, and then a dyeing process is conducted, followed by a washing process.

26 Claims, 2 Drawing Sheets

CLOTH SUITABLE FOR INK-JET TEXTILE PRINTING AND INK-JET TEXTILE PRINTING METHOD

This application is a division of application No. 08/008,332, filed Jan. 25, 1993, now U.S. Pat. No. 5,494,733.

BACKGROUND OF THE INVENTION

1. Field of the Invention

This invention relates to a cloth suitable for ink-jet textile printing and an ink-jet textile printing method and, in particular, to a cloth suitable for ink-jet textile printing which is mainly composed of cellulosic fibers and which exhibits a high degree of exhaustion and high coloring property when used in the formation of a printed image by ink-jet textile printing, making it possible to obtain a clear and fine pattern, and to an ink-jet textile printing method using such a cloth.

2. Description of the Related Art

At present, screen textile printing and roller textile printing are the most common methods of textile printing. A problem with these methods is that they require preparation of a plate, so that they are not suitable for the production of a variety of articles in small quantities. Further, it is hard to quickly adapt these methods to the fashions of the day. In view of this, an electronic textile-printing system requiring no plate making is presently desired. To meet this requirement, a number of textile-printing methods based on ink-jet recording have been proposed, which are designed to address these problems.

The following are examples of the characteristics required of a cloth used in ink-jet textile printing:

(1) Ability to allow the ink to color in sufficient density.

(2) High degree of exhaustion for the ink.

(3) Ability to allow the ink to dry quickly thereon.

(4) Little generation of irregular ink blurring thereon.

(5) Ease with which the cloth is fed within the printing apparatus.

These requirements have typically been satisfied by performing pre-processes on the cloth.

For example, Japanese Patent Laid-Open No. 62-53492 discloses a kind of cloth having an ink-reception layer, and Japanese Patent Publication No. 3-46589 proposes a cloth impregnated with a reduction preventing agent or an alkaline substance.

Although these pre-processes have proved partly effective with respect to the above requirements, the quality of the printed image after the final process depends on the basic characteristics of the cloth material used. Thus, a satisfactory material cannot be obtained by such pre-processes.

Thus, although the prior-art techniques can satisfy the above requirements to some extent, a cloth suitable for ink-jet textile printing or ink-jet textile printing method has not previously been known which satisfies all the above requirements at the same time and solves the above-mentioned problems, thereby providing an image of the highest quality.

SUMMARY OF THE INVENTION

It is accordingly an object of this invention to provide a cloth suitable for ink-jet textile printing and an ink-jet textile-printing method which satisfy all the above-mentioned general requirements of conventional cloths for ink-jet textile printing, that is, the requirements in dyeing technique to obtain an article dyed clearly with no ink blurring and in high density, the requirements in cost to provide high degree of exhaustion for the ink, the requirements in operation to provide high fixation property for the ink and ease with which it can be fed within the printing apparatus, etc.

In accordance with this invention, the above object is achieved by a cloth suitable for ink-jet textile printing which is mainly composed of cellulosic fibers having an average fiber length of 25 to 60 mm, the cloth having a moisture regain of 13.5 to 108.5%.

This invention further provides a cloth suitable for ink-jet textile printing which is mainly composed of cellulosic fibers having an average thickness of 0.6 to 2.2 d and an average natural twist of 70 to 150/cm, the cloth having a moisture regain of 13.5 to 108.5%.

In accordance with this invention, there is further provided a cloth suitable for ink-jet textile printing which is mainly composed of regenerated cellulosic fibers and which has a moisture regain of 13.5 to 108.5%.

Further, in accordance with this invention, there is provided an ink-jet textile-printing method in which a textile printing ink is imparted to a cloth, wherein the cloth is mainly composed of cellulosic fibers having an average fiber length of 25 to 60 mm, the cloth having a moisture regain of 13.5 to 108.5%, and wherein, after imparting ink to the cloth, a dyeing process is conducted, and then a washing process is conducted.

This invention further provides an ink-jet textile-printing method in which a textile printing ink is imparted to a cloth, wherein the cloth is mainly composed of cellulosic fibers having an average fiber thickness of 0.6 to 2.2 d and an average natural twist of 70 to 150/cm, the cloth having a moisture regain of 13.5 to 108.5%, and wherein, after imparting ink to the cloth, a dyeing process is conducted, and then a washing process is conducted.

In accordance with this invention, there is further provided an ink-jet textile-printing method in which a textile printing ink is imparted to a cloth, wherein the cloth is mainly composed of regenerated cellulosic fibers and has a moisture regain of 13.5 to 108.5%, and wherein, after imparting ink to the cloth, a dyeing process is conducted, and then a washing process is conducted.

DESCRIPTION OF THE PREFERRED EMBODIMENTS

Figure 1:
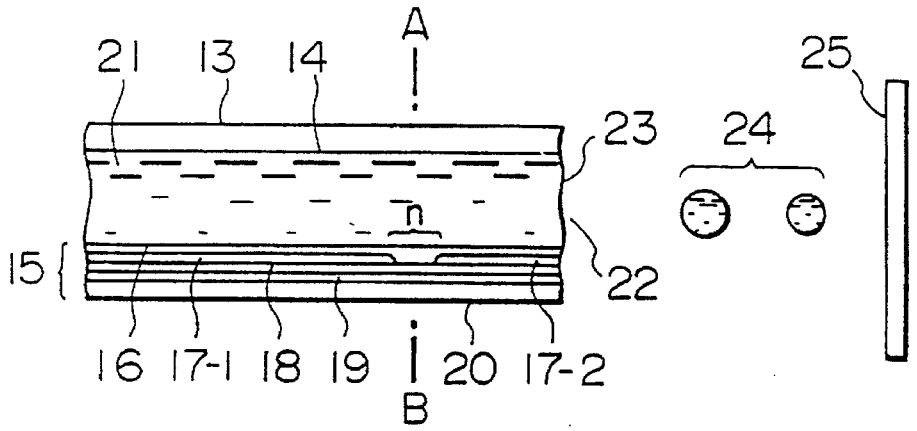
FIG. 1 is a longitudinal sectional view of a head section of an ink-jet recording apparatus.

While attempting to improve a cloth suitable for ink-jet textile printing mainly composed of cellulosic fibers so that it may satisfy the various requirements mentioned above, the present inventors found that, apart from the improvements effected, for example, by conducting pre-processes on the cloth as in the prior art, it is possible to remarkably improve the various properties of the cloth, such as coloring property, degree of exhaustion, fixing property, blurring retardation and feeding property, by keeping the moisture regain, which is a basic characteristic of the material, within a fixed range.

This phenomenon appears to be attributable to the fact that impregnation of the cloth with an amount of water larger than the normal amount optimizes the degree of swelling of the fibers, so that even if printing is performed using low-viscosity ink-jet printing inks of various types having a much lower viscosity as compared to the printing pastes conventionally known, the cloth is enabled to display its printing properties to the utmost.

Further, the present inventors have found that it is possible to still further improve the various properties of the cloth, such as coloring property, degree of exhaustion, fixing property, blurring retardation and feeding property, by keeping the average length of the fibers composing the cloth within a fixed range, which length is a basic characteristic of the material, in addition to controlling the moisture regain of the cloth, thus attaining the present invention.

This phenomenon appears to be attributable to the fact that using fibers longer than the usual ones results in a reduction of the absolute number of fiber ends and makes the cloth resistant to the generation of straw-like irregular stains, which generation seems to be caused by the fiber ends. Thus, the fibers are smoothly intertwined, so that even if printing is performed using low-viscosity ink-jet printing inks of various types having a much lower viscosity as compared to the printing pastes conventionally known, the cloth is enabled to display its printing properties to the utmost.

The present inventors have also found that it is possible to still further improve the various properties of the cloth, such as coloring property, degree of exhaustion, fixing property, blurring retardation and feeding property, by keeping the average thickness and average natural convolution of the fibers composing the cloth, which are basic characteristics of the material, within fixed ranges, in addition to controlling the moisture regain of the cloth, thus attaining the present invention.

This phenomenon appears to be attributable to the fact that using fibers thinner than the usual ones results in an increase in the absolute number of dye adsorption seats (countable sections where dye molecules can be bonded with cellulosic fibers by covalent bond or ionic bond) of the fibers, thereby improving various dyeing properties of the cloth. Further, by keeping the thickness of fibers having a considerable natural twist at a certain degree of thinness, the fibers are intertwined in an ideal condition, so that even if printing is performed using low-viscosity ink-jet printing inks of various types having a much lower viscosity as compared to the printing pastes conventionally known, the cloth is enabled to display its printing properties to the utmost.

An ink-jet textile printing which uses, as stated above, an ink having a much lower viscosity as compared with conventional printing paste, forming images by a dot expression of this ink, involves an extremely large number of restrictions with respect to the physical conditions of the cloth. This is particularly true in the case of a cloth mainly composed of cellulosic fibers.

However, it has been ascertained that, in the case of a cloth mainly composed of regenerated cellulosic fibers, the influence of the configuration of the fibers is relatively small, so that the above-mentioned various properties of the cloth can be improved solely by adjusting the moisture regain thereof.

This phenomenon appears to be attributable to the fact that regenerated fibers are formed by melt spinning, so that the ink absorption and dye adsorption of the polymer chains of the fibers are superior to those of natural cellulosic fibers.

Next, the present invention will be described in more detail with reference to preferred embodiments.

The cloth suitable for ink-jet textile printing of the present invention consists of a cloth mainly composed of cellulosic fibers with an average fiber length of 25 to 60 mm and having a moisture regain of 13.5 to 108.5%, or a cloth which is mainly composed of cellulosic fibers with an average thickness of 0.6 to 2.2 d and an average natural convolution of 70 to 150/cm and which has a moisture regain of 13.5 to 108.5%.

The cloth of the present invention is mainly composed of cellulosic fibers. The cellulosic fibers are fibers whose main component is cellulose, and include natural cellulosic fibers, such as cotton and hemp, and regenerated cellulosic fibers, such as rayon and cupra. Above all, cotton fibers, which are cellulosic fibers obtained from vegetable seeds, are suitable for use in the present invention.

A "cloth suitable for textile printing" implies a woven fabric, a non-woven fabric, a knitted fabric, and a plush fabric. Although it is naturally desirable for the cloth to be made of 100% cellulosic fibers, a blended woven or unwoven fabric or the like, consisting of cellulosic fibers and other materials, can also be used as a cloth suitable for ink-jet textile printing according to this invention, if the blending ratio is 70% or more or, more preferably, 80% or more.

The moisture regain, which is a characterizing factor of the cloth suitable for ink-jet textile printing of this invention, ranges from 13.5 to 108.5%, more preferably, from 14.5 to 88.5%, and most preferably, from 15.5 to 68.5%. A moisture regain of less than 13.5% results in problems in coloring property and degree of exhaustion. A moisture regain of more than 108.5%, on the other hand, results in problems in feeding property and blurring.

The measurement of the moisture regain of the cloth was conducted referring to Japanese Industrial Standard L 1019. That is, 100 g of a sample were accurately weighed and put in a desiccator at 105°±2° C. to be dried until a constant weight was reached. The moisture regain of the cloth was obtained by the following formula:

$$\text{Moisture regain}=\{(W-W')/W'\}\times 100$$

(where W: weight before drying; and W': weight after drying)

In the case of a cloth which had undergone a pre-process using an alkaline substance or the like, a washing process was conducted after drying the cloth until a constant weight was reached, and then drying was performed again until a constant weight was reached. Then, only the weight of the fiber portion after drying was measured. Then, the moisture regain of the cloth was obtained by the following formula:

$$\text{Moisture regain}=\{(W-W')/W''\}\times 100$$

(where W": weight of the fiber portion after washing and drying)

Further, the cloth suitable for ink-jet textile printing of this invention is characterized in that the cellulosic fibers composing the cloth have an average fiber length of 25 to 60 mm.

The above average fiber length, ranging from 25 to 60 mm, which characterizes the cloth suitable for ink-jet textile printing of this invention, ranges, more preferably, from 30 to 55 mm and, most preferably, from 35 to 50 mm. An average fiber length of less than 25 mm is not desirable since it leads to blurring generation and problems in resolution. An average fiber length of more than 60 mm, on the other hand, leads to problems in feeding property and degree of exhaustion, so that it is also not desirable.

The above average fiber length was obtained by the staple diagram method, referring to Japanese Industrial Standard L 1019.

In another aspect of this invention, the cloth suitable for ink-jet textile printing is characterized in that the cellulosic fibers composing the cloth have an average thickness of 0.6 to 2.2 d and an average natural twist of 70 to 150/cm.

The above average thickness, ranging from 0.6 to 2.2 d, which characterizes the cloth suitable for ink-jet textile printing of this invention, ranges, more preferably, from 0.7 to 2.0 d, and most preferably, from 0.8 to 1.8 d. An average fiber thickness of less than 0.6 d is not desirable since it leads to a reduction in the degree of exhaustion and problems in feeding properties. An average fiber thickness of more than 2.2 d, on the other hand, leads to generation of blurring and problems in resolution, so that it is also not desirable.

The above average natural twist, ranging from 70 to 150/cm, which characterizes the cloth suitable for ink-jet textile printing of this invention, ranges, more preferably, from 80 to 150/cm and, most preferably, from 90 to 150/cm. A natural twist of less than 70/cm is not desirable since it results in a reduction in degree of exhaustion, generation of blurring, and problems in resolution. A natural twist of more than 150/cm, on the other hand, leads to problems in feeding property, so that it is also not desirable.

In the measurement of the average fiber thickness, a Micronaire fineness was obtained by the Micronaire method and converted to a weight per 9000 m, which was expressed in d (denier).

Regarding the average natural twist of the fibers, fifty cellulosic fibers were arbitrarily extracted from the cloth, and were individually examined for twist by a microscope to obtain a twist value per 1 cm for each. Then, the average of these twist values was obtained.

In addition to the above-mentioned preferred factors, conventional pre-processes as mentioned above may be performed, as needed, on the cloth suitable for ink-jet textile printing of this invention. It should be noted, in particular, that, in some cases, it is more desirable to impregnate the cloth with 0.01 to 5 wt % of an alkaline substance with respect to the weight of the dried cloth, thereby controlling the moisture regain of the cloth, or to impregnate the cloth with 0.01 to 20 wt % of a substance selected from the following group: a water-soluble metallic salt, a water-soluble high molecular weight polymer, urea, and thiourea, thereby controlling the moisture regain of the cloth.

Examples of the "alkaline substance" in this invention include: alkaline-metal hydroxides, such as sodium hydroxide and potassium hydroxide; amines, such as mono-, di- and triethanolamines; and carbonates or bicarbonates of alkaline metals, such as sodium carbonate, potassium carbonate and sodium bicarbonate. Organic-acid metallic salts, such as calcium acetate and barium acetate, ammonia and ammoniates, are also included. Further, it is possible to use sodium trichloroacetate or the like, which becomes an alkaline substance by steaming or hot air. Sodium carbonate and sodium bicarbonates, which are used in dyeing with reactive dyes, are examples of a particularly desirable alkaline substance.

Examples of the water-soluble high molecular weight polymer include: starch substances, such as corn and wheat flour; cellulose-type substances, such as carboxymethyl cellulose, methyl cellulose and hydroxyethyl cellulose; polysaccharides, such as sodium alginate, gum arabic, locust bean gum, tragacanth gum, guar gum and tamarind seeds; protein substances, such as gelatin and casein; natural water-soluble high molecular weight polymers, such as tannin-type substances and lignin-type substances.

Examples of a synthetic high molecular weight polymer include: polyvinyl alcohol compounds, polyethylene oxide compounds, acrylic-type water-soluble high molecular weight polymers, and maleic-anhydride-type water-soluble high molecular weight polymers. Of these, the polysaccharide-type high polymers and the cellulose-type high polymers are especially preferable.

Examples of the water-soluble metallic salt includes compounds forming typical ionic crystals and having a pH ranging from 4 to 10, like halides of alkaline metals or alkaline earth metals. Typical examples of the alkaline-metal salt include: NaCl, $Na_2SO_4$, KCl and $CH_3COONa$. Typical examples of the alkaline-earth-metal salt include: $CaCl_2$ and $MgCl_2$. Of these, salts of Na, K and Ca are especially preferable.

There is no particular limitation regarding the textile-printing ink used for the ink-jet textile-printing cloth of this invention as long as the ink is capable of dyeing cellulosic fibers. An ink-jet textile-printing ink composed of a reactive dye and an aqueous liquid medium is preferably employed.

In the method of this invention, a reactive dye is preferable which has at least 5 to 30 wt % of vinyl sulfonic groups and/or monochlorotriazine groups. Typical concrete examples of such a dye include: C.I. Reactive Yellow 2, 15, 37, 42, 76 and 95; C.I. Reactive Red 21, 22, 24, 33, 111, 112, 114, 180, 218 and 226; C.I. Reactive Blue 15, 19, 21, 38, 49, 72, 77, 176, 203 and 220; C.I. Reactive Orange 5, 12, 13 and 35; C.I. Reactive Brown 7, 11, 22 and 46; C.I. Reactive Green 8 and 19; C.I. Reactive Violet 2, 6 and 22; and C.I. Reactive Black 5, 8, 31 and 39. Other preferable dyes include reactive dyes having at least two reactive groups. Examples of such dyes include: C.I. Reactive Yellow 168 and 175; C.I. Reactive Red 228 and 235; C.I. Reactive Blue 230 and 235; C.I. Reactive Orange 95; and C.I. Reactive Brown 37. These dyes, which have two or more reactive groups in one dye molecule, can be used alone or in the form of a mixture, or as a mixture having different hues. The present invention, however, is not limited to these dyes.

One or more of these dyes, whose hues may differ from each other, are contained in an ink. The amount of dye used generally ranges from 5 to 30 wt %, more preferably, from 5 to 25 wt % and, most preferably, from 5 to 20 wt %, with respect to the total ink amount. Dye less than 5 wt % results in insufficient coloring density, and more than 30 wt % results in insufficient ink ejection property.

In another preferable form of the invention, approximately 10 to 20,000 ppm of chlorine ions and/or sulfate ions are added, with respect to the amount of reactive dyes contained in the ink, and approximately 0.1 to 30 ppm in total of at least one kind of substance selected from the group: silicon, iron, nickel and zinc, is added to the ink. When such an ink is used on the cloth suitable for ink-jet textile printing of this invention, it is possible to obtain a clearly printed dyed article with a high degree of exhaustion, high density and with no blurring. Further, use of such an ink makes possible a textile printing with high ejection performance, which generates no clogging or the like in the head nozzle for a long period of time.

In addition to the above-mentioned metallic salts, it is desirable for the ink to contain a total amount of calcium and/or magnesium of 0.1 to 30 ppm, more preferably, 0.2 to 20 ppm and, most preferably, 0.3 to 10 ppm, thereby attaining further improvement particularly in the degree of exhaustion.

Water, which is a preferred component of the liquid medium composing the ink of the ink-jet textile printing of this invention, composes 30 to 90 wt %, more preferably, 40 to 90 wt % and, most preferably, 50 to 85 wt %, with respect to the total ink amount.

The above are the preferred components of the ink-jet textile-printing ink used in the method of this invention. However, it is also possible to adopt a generally used organic solvent as the liquid medium of the ink. Examples of such an organic solvent include: ketones or keto alcohols, such as acetone and diacetone alcohol; ethers, such as tetrahydrofuran and dioxane; addition polymers of oxyethylene or oxypropylene, such as diethylene glycol, triethylene glycol, tetraethylene glycol, diproplyene glycol, tripropylene glycol, polyethylene glycol and polypropylene glycol; alkylene glycols having two to six carbon atoms, such as ethylene glycol, propylene glycol, trimethylene glycol, butylene glycol and hexylene glycol; triols, such as 1,2,6-hexanetriol; thiodiglycol; glycerin; low alkylethers of polyhydric alcohols, such as ethyleneglycol monomethyl (or ethyl) ether, diethyleneglycol monomethyl (or ethyl) ether and triethyleneglycol monomethyl (or ethyl) ether; low dialkylethers of polyhydric alcohols, such as triethyleneglycol dimethyl (or ethyl) ether and tetraethyleneglycol dimethyl (or ethyl) ether; Sulfonine, N-methyl-2-pyrolidone, 1,3-dymethyl-2-imidazolidinone, etc.

The content of the above water-soluble organic solvents is generally 3 to 60 wt % and, more preferably, 5 to 50%, with respect to the total weight of the ink.

Liquid mediums as mentioned above may be used alone or in a mixture. The most desirable liquid-medium composition contains at least one type of polyhydric alcohol. A composition consisting of thioglycol alone or a mixture of diethyleneglycol and thiodiglycol is especially preferable.

Further, it is possible to add, as needed, various types of dispersing agents, surface active agents, viscosity controlling agents, surface tension controlling agents, fluorescent whitening agents, etc., to the ink used in the method of this invention, having principal components as mentioned above.

Examples of such additives include: viscosity controlling agents, such as polyvinyl alcohol, celluloses and water-soluble resins; various surface active agents of cationic or nonionic type; surface tension controlling agents, such as diethanolamine and triethanolamine; pH regulators with buffer solution, anti-mildew agents, etc.

In the ink-jet textile-printing method of this invention, textile printing is performed on an ink-jet textile-printing cloth according to this invention, using a textile-printing ink as described above. Any known ink-jet recording system may be employed. The most effective example of the ink-jet recording system is disclosed in Japanese Patent Laid-Open No. 54-59936, in which the volume of ink increases rapidly by the action of heat energy and, as a result of this change in state, the ink is ejected through the nozzles. By performing recording on the ink-jet textile-printing cloth of this invention with such a system, stable printing is possible.

To achieve very effective printing, it is desirable that the ejected droplets be within the range of 20 to 200 pl ($10^{-12}$ l) and the ink application within the range of 4 to 40 nl/mm$^2$.

An example of an apparatus suitable for textile printing using the ink-jet textile-printing cloth of this invention is one which imparts heat energy corresponding to recording signals to the ink in the recording-head chamber, causing ink droplets to be generated by heat energy.

Figure 2:
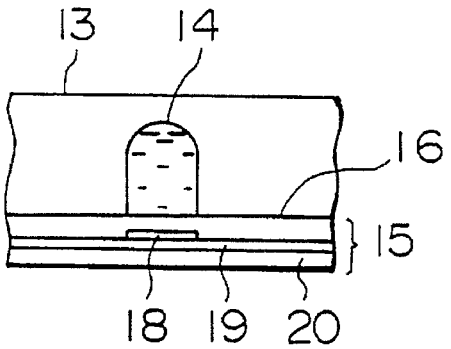
FIG. 2 is a cross-sectional view of the head section of the ink-jet recording apparatus.
Figure 3:
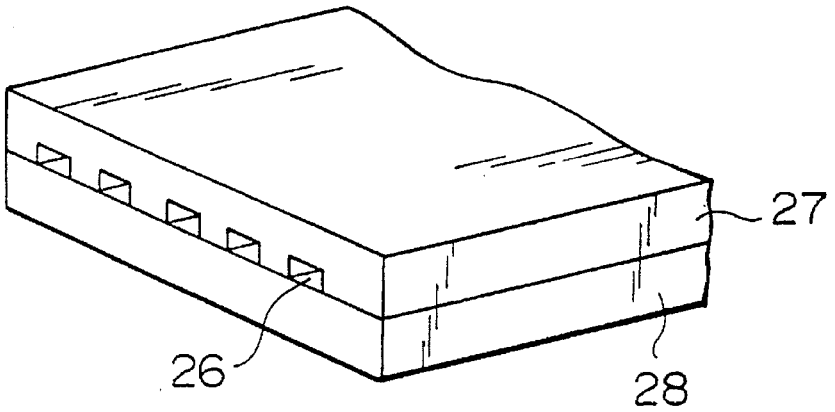
FIG. 3 is an outward perspective view of the head of FIG. 1 formed as a multi-head.

FIGS. 1, 2 and 3 show an example of the construction of the head which constitutes the principal section of the apparatus.

A head 13 is formed by gluing a plate made of glass, a ceramic material or plastic and having a groove 14 passing ink, to a heat generating head 15 used in thermal recording (though the drawings show a head, the present invention is not limited to such a head). The heat generating head 15 is composed of a protective layer 16 made of silicon oxide or the like, aluminum electrodes 17-1 and 17-2, a heat-generating-resistor layer 18 made of nichrome or the like, a heat storage layer 19, and a substrate 20 made of a material having satisfactory radiation properties, such as alumina.

Ink 21 reaches an ejection orifice (a minute hole) 22, forming a meniscus 23 by a pressure P.

When an electrical signal is applied to the electrodes 17-1 and 17-2, the region of the heat generating head 15 which is indicated at n, generates heat rapidly, and a bubble is generated in the portion of the ink 21 which is in contact with the region n. The pressure of the bubble causes the meniscus 23 to protrude beyond the orifice 22, thereby ejecting the ink 21, which is turned into recording droplets 24 as it leaves the orifice 22, ejected toward the cloth 25 of this invention mainly formed of cellulosic fibers. FIG. 3 shows the outward appearance of a multi-head formed by arranging a number of heads together as shown in FIG. 1. This multi-head is produced by closely attaching a glass plate 27 having multi-grooves 26 to a heat generating head 28 similar to the one described with reference to FIG. 1. FIG. 1 is a sectional view of the head 13 taken along the ink flow passage, and FIG. 2 is a sectional view taken along the line A-B of FIG. 1.

Figure 4:
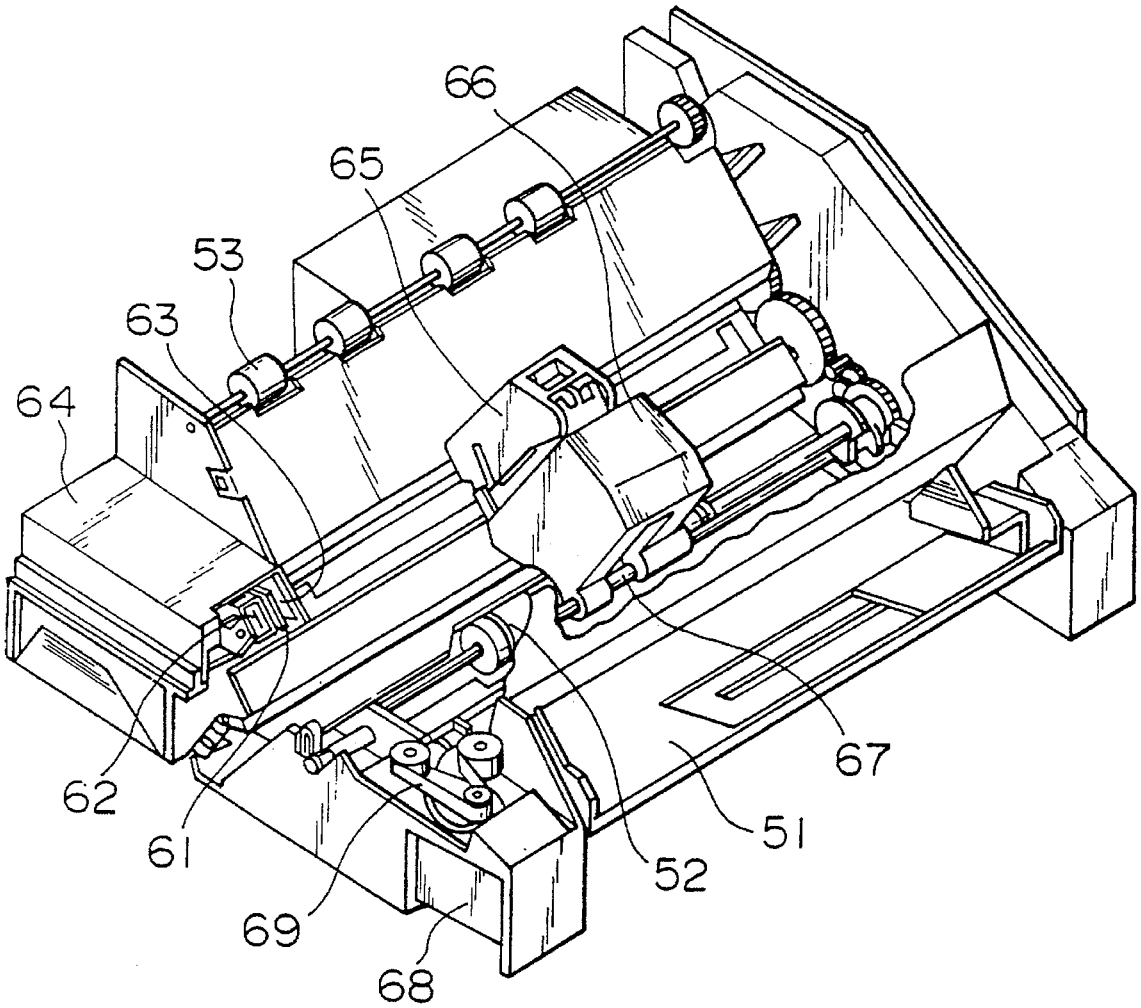
FIG. 4 is a perspective view showing an example of an ink-jet recording apparatus.

FIG. 4 shows an example of an ink-jet recording apparatus with such a head incorporated therein. Numeral 61 indicates a blade serving as a wiping member, one end of which is held by a blade holding member forming a fixed end, thus exhibiting a cantilever-like structure. The blade 61 is arranged adjacent to the area where recording is performed by the recording head. In this example, the blade 61 is held in a position in which it protrudes into the path of movement of the recording head. Numeral 62 indicates a cap, which is arranged at a home position adjacent to the blade 61 and which is adapted to move in a direction perpendicular to the direction of movement of the recording head, abutting the ejection surface of the head, thereby effecting capping. Numeral 63 indicates an absorbing member provided adjacent to the blade 61 and held, like the blade 61, in a position in which it protrudes into the path of movement of the recording head. The blade 61, the cap 62 and the absorbing member 63 constitute an ejection-performance recovery section 64, which removes water, dust, etc. from the ink-ejection surface by the blade 61 and the absorbing member 63.

Numeral 65 indicates a recording head which has an energy generating means and which ejects ink onto a cloth containing cellulosic fibers and opposed to the ejection surface of the head having ejection outlets, thereby effecting recording. Numeral 66 indicates a carriage for moving the recording head 65, which is mounted thereon. The carriage 66 is slidably engaged with a guide shaft 67, and a part of the carriage 66 is connected with a belt 69 (the connection is not shown) driven by a motor 68. Due to this arrangement, the carriage 66 can move along the guide shaft 67, making it possible for the recording head 65 to move across the area where recording is performed and the area adjacent thereto.

Numeral 51 indicates a cloth feeding section for inserting the cloth of this invention, which is mainly composed of cellulosic fibers. Numeral 52 indicates a paper feeding roller driven by a motor (not shown). Due to this construction, the cloth of this invention is fed to a position where it faces the ejection-outlet surface of the recording head. As the recording proceeds, the cloth is transferred to a cloth discharge section where cloth-discharge rollers 53 are arranged.

In the above construction, when the recording head 65 returns to the home position after the completion of recording, etc., the cap 62 of the ejection-performance recovery section 64 is withdrawn from the path of movement of the recording head 65, whereas the blade 61 continues to protrude into the path of movement. As a result, the ejection-outlet surface of the recording head 65 is wiped. When the cap 62 is brought into abutment with the ejection-outlet surface of the recording head 65 so as to effect capping, the cap 62 is moved in such a way as to protrude into the path of movement of the recording head.

When the recording head 65 moves from the home position to the recording start position, the cap 62 and the blade 61 are at the same positions as those where the above-described wiping is performed. As a result, the ejection-outlet surface of the recording head 65 is also wiped in the course of this movement.

The above movement of the recording head to the home position is performed not only upon completion of recording or at the time of ejection-performance recovery, but also during the movement of the recording head across the recording area for the purpose of recording. That is, during recording movement, the recording head moves at fixed intervals to the home position adjacent to the recording area, effecting the above-mentioned wiping.

The textile-printing ink, which has been imparted, by the method of this invention, to the ink-jet textile-printing cloth of this invention, is only sticking to the cloth. Thus, it is desirable that a process for fixing the ink to the cloth by reactive fixation and a process of removing unfixed dye should follow. The two processes may be effected by conventionally known methods, such as steaming, HT steaming or thermofixing. When a cloth which has undergone alkali processing beforehand is not used, the above fixation and removal can be effected by conventionally known methods in which washing is conducted after processing by the alkali-pad steaming method, alkali blotch steaming method, alkali shock method, alkali cold fixation method or the like.

EXAMPLES

Next, this invention will be described in more detail with reference to examples thereof and comparative examples. In the following, "parts" and "%" mean "parts by weight" and "weight %", respectively, unless otherwise noted.

Production of Ink (A)

| | |
|---|---|
| reactive dye (C.I. Reactive Yellow 95) | 10 parts |
| thiodiglycol | 24 parts |
| diethylene glycol | 11 parts |
| potassium chloride | 0.004 parts |
| sodium sulfate | 0.002 parts |
| sodium metasilicate | 0.001 parts |
| iron chloride | 0.0005 parts |
| water | 55 parts |

The above components were mixed with each other, and the solution was adjusted to a pH of 8.4 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (A).

Production of Ink (B)

| | |
|---|---|
| reactive dye (C.I. Reactive Red 24) | 10 parts |
| thiodiglycol | 15 parts |
| diethylene glycol | 10 parts |
| tetraethylene glycol dimethylether | 5 parts |
| potassium chloride | 0.04 parts |
| sodium sulfate | 0.01 parts |
| sodium metasilicate | 0.001 parts |
| iron chloride | 0.0005 parts |
| nickel chloride | 0.0002 parts |
| water | 60 parts |

The above components were mixed with each other, and the solution was adjusted to a pH of 7.9 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (B).

Production of Ink (C)

| | |
|---|---|
| reactive dye (C.I. Reactive Blue 72) | 13 parts |
| thiodiglycol | 23 parts |
| triethylene glycol monomethylether | 6 parts |
| potassium chloride | 0.05 parts |
| sodium metasilicate | 0.001 parts |
| iron chloride | 0.0005 parts |
| zinc chloride | 0.0003 parts |
| water | 58 parts |

The above components were mixed with each other, and the solution was adjusted to a pH of 8.3 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (C).

Production of ink (D)

| | |
|---|---|
| reactive dye (C.I. Reactive Brown 11) | 2 parts |
| reactive dye (C.I. Reactive Orange 12) | 1.5 parts |
| reactive dye (C.I. Reactive Black 39) | 6.5 parts |
| thiodiglycol | 23 parts |
| diethylene glycol | 5 parts |
| isopropyl alcohol | 3 parts |
| potassium sulfate | 0.01 parts |
| sodium metasilicate | 0.001 parts |
| iron sulfate | 0.0005 parts |
| nickel sulfate | 0.0003 parts |
| zinc sulfate | 0.0003 parts |
| water | 59 parts |

The above components were mixed with each other, and the solution was adjusted to a pH of 8.2 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (D).

Production of Ink (E)

| | |
|---|---|
| reactive dye (C.I. Reactive Blue 49) | 15 parts |
| thiodiglycol | 16 parts |
| diethylene glycol | 17 parts |
| sodium chloride | 0.08 parts |
| potassium sulfate | 0.01 parts |
| sodium metasilicate | 0.0005 parts |
| iron sulfate | 0.001 parts |
| nickel chloride | 0.0003 parts |

-continued

| | |
|---|---|
| zinc sulfate | 0.0003 parts |
| water | 51.9 parts |

The above components were mixed with each other, and the solution was adjusted to a pH of 7.7 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (E).

Production of ink (F)

| | |
|---|---|
| reactive dye (C.I. Reactive Blue 49) | 15 parts |
| thiodiglycol | 16 parts |
| diethylene glycol | 17 parts |
| sodium chloride | 0.08 parts |
| potassium sulfate | 0.01 parts |
| sodium metasilicate | 0.0005 parts |
| iron sulfate | 0.001 parts |
| nickel chloride | 0.0003 parts |
| zinc sulfate | 0.0003 parts |
| calcium chloride | 0.006 parts |
| water | 51.9 parts |

The above components were mixed with each other, and the solution was adjusted to a pH of 7.7 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (F).

Production of Ink (G)

| | |
|---|---|
| reactive dye (C.I. Reactive Blue 49) | 15 parts |
| thiodiglycol | 16 parts |
| diethylene glycol | 17 parts |
| sodium chloride | 0.08 parts |
| potassium sulfate | 0.01 parts |
| sodium metasilicate | 0.0005 parts |
| iron sulfate | 0.001 parts |
| nickel chloride | 0.0003 parts |
| zinc sulfate | 0.0003 parts |
| magnesium chloride | 0.01 parts |
| water | 51.9 parts |

The above components were mixed with each other, and the solution was adjusted to a pH of 7.7 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (G).

Production of Ink (H)

| | |
|---|---|
| reactive dye (C.I. Reactive Yellow 168) | 10 parts |
| thiodiglycol | 23 parts |
| diethylene glycol | 12 parts |
| potassium chloride | 0.004 parts |
| sodium sulfate | 0.002 parts |
| sodium metasilicate | 0.001 parts |
| iron chloride | 0.0005 parts |
| water | 55 parts |

The above components were mixed with each other, and the solution was adjusted to a pH of 8.4 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (H).

Production of Ink (I)

| | |
|---|---|
| reactive dye (C.I. Reactive Red 235) | 10 parts |
| thiodiglycol | 13 parts |
| diethylene glycol | 11 parts |
| tetraethylene glycol dimethylether | 6 parts |
| potassium chloride | 0.04 parts |
| sodium sulfate | 0.01 parts |
| sodium metasilicate | 0.001 parts |
| iron chloride | 0.0005 parts |
| nickel chloride | 0.0002 parts |
| water | 60 parts |

The above components were mixed with each other, and the solution was adjusted to a pH of 7.9 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (I).

Production of Ink (J)

| | |
|---|---|
| reactive dye (C.I. Reactive Blue 235) | 13 parts |
| thiodiglycol | 25 parts |
| triethylene glycol monomethylether | 6 parts |
| potassium chloride | 0.05 parts |
| sodium metasilicate | 0.001 parts |
| iron chloride | 0.0005 parts |
| zinc chloride | 0.0003 parts |
| water | 56 parts |

The above components were mixed with each other, and the solution was adjusted to a pH of 8.3 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (J).

Production of Ink (K)

| | |
|---|---|
| reactive dye (C.I. Reactive Blue 230) | 6.5 parts |
| reactive dye (C.I. Reactive Brown 11) | 2 parts |
| reactive dye (C.I. Reactive Orange 12) | 1.5 parts |
| thiodiglycol | 24 parts |
| diethylene glycol | 5 parts |
| isopropyl alcohol | 2 parts |
| potassium sulfate | 0.01 parts |
| sodium metasilicate | 0.001 parts |
| iron sulfate | 0.0005 parts |
| nickel sulfate | 0.0003 parts |
| zinc sulfate | 0.0003 parts |
| water | 59 parts |

The above components were mixed with each other, and the solution was adjusted to a pH of 8.2 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (K).

Production of Ink (L)

| | |
|---|---|
| reactive dye (C.I. Reactive Brown 37) | 15 parts |
| thiodiglycol | 18 parts |
| diethylene glycol | 15 parts |
| sodium chloride | 0.08 parts |
| potassium sulfate | 0.01 parts |
| sodium metasilicate | 0.0005 parts |
| iron sulfate | 0.001 parts |
| nickel chloride | 0.0003 parts |

-continued

| | |
|---|---|
| zinc sulfate | 0.0003 parts |
| water | 51.9 parts |

The above components were mixed with each other, and the solution was adjusted to a pH of 7.7 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (L).

Production of Ink (M)

| | |
|---|---|
| reactive dye (C.I. Reactive Brown 37) | 15 parts |
| thiodiglycol | 16 parts |
| diethylene glycol | 17 parts |
| sodium chloride | 0.08 parts |
| potassium sulfate | 0.01 parts |
| sodium metasilicate | 0.0005 parts |
| iron sulfate | 0.001 parts |
| nickel chloride | 0.0003 parts |
| zinc sulfate | 0.0003 parts |
| calcium chloride | 0.006 parts |
| water | 51.9 parts |

The above components were mixed with each other, and the solution was adjusted to a pH of 7.7 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (M).

Production of Ink (N)

| | |
|---|---|
| reactive dye (C.I. Reactive Brown 37) | 15 parts |
| thiodiglycol | 16 parts |
| diethylene glycol | 17 parts |
| sodium chloride | 0.08 parts |
| potassium sulfate | 0.01 parts |
| sodium metasilicate | 0.0005 parts |
| iron sulfate | 0.001 parts |
| nickel chloride | 0.0003 parts |
| zinc sulfate | 0.0003 parts |
| magnesium chloride | 0.01 parts |
| water | 51.9 parts |

The above components were mixed with each other, and the solution was adjusted to a pH of 7.7 by sodium hydroxide. The solution was stirred for two hours, and then filtered by a Floroporefilter-FP-100 (trade name, manufactured by Sumitomo Electric Industries, Ltd.), thereby obtaining an ink-jet textile-printing ink (N).

EXAMPLE 1

A woven fabric of 100% cotton, formed by using American raw cotton having an average fiber length of 45 mm, was immersed in a water vessel, and its moisture regain was adjusted to 20% by adjusting the squeezing ratio.

Printing was performed on this woven fabric by a Color Bubble Jet Copier PIXEL PRO (trade name, manufactured by Canon Inc.) provided with inks (A) thorough (G) obtained as described above, thereby obtaining a solid sample of 2×10 cm under ink application conditions of 16 nl/mm$^2$. Fixation was effected by steaming for two minutes at 100° C. After that, the sample was washed in neutral detergent, and was then evaluated for clarity and blurring retardation. The evaluation results are given in Table 1.

EXAMPLE 2

A woven fabric composed of 85% cotton having an average fiber length of 50 mm, and 15% of polyester, was immersed in a water vessel, and its moisture regain was adjusted to 40% by adjusting the squeezing ratio.

Printing was performed on this woven fabric in the same manner as in Example 1, and the dyed article was evaluated for clarity and blurring retardation. The evaluation results are given in Table 1.

EXAMPLE 3

A woven fabric of 100% viscose rayon was immersed in a water vessel, and its moisture regain was adjusted to 25% by adjusting the squeezing ratio.

Printing was performed on this woven fabric in the same manner as in Example 1, and the dyed article was evaluated for clarity and blurring retardation. The evaluation results are given in Table 1.

EXAMPLE 4

A georgette cloth of 100% cotton having an average fiber length of 35 mm was immersed in a water vessel, and its moisture regain was adjusted to 20% by adjusting the squeezing ratio.

Printing was performed on this georgette cloth in the same manner as in Example 1, and the dyed article was evaluated for clarity and blurring retardation. The evaluation results are given in Table 1.

EXAMPLE 5

A woven fabric like that of Example 1, of 100% cotton, was immersed beforehand in an aqueous solution of sodium hydroxide having a concentration of 10%, and its moisture regain was adjusted to 15% by adjusting the squeezing ratio.

Printing was performed on this woven fabric in the same manner as in Example 1, and the dyed article was evaluated for clarity and blurring retardation. The evaluation results are given in Table 1.

EXAMPLE 6

A woven fabric like that of Example 1, of 100% cotton, was immersed beforehand in an aqueous solution of thiourea having a concentration of 15%, and its moisture regain was adjusted to 15% by adjusting the squeezing ratio.

Printing was performed on this woven fabric in the same manner as in Example 1, and the dyed article was evaluated for clarity and blurring retardation. The evaluation results are given in Table 1.

EXAMPLES OF 7 TO 12

The same procedures as those of Examples 1 through 6 were executed except that inks (H) through (N) were used instead of the inks used in Examples 1 through 6, obtaining the results given in Table 1.

EXAMPLE 13

A woven fabric of 100% cotton formed by using Egyptian cotton having an average fiber length of 35 mm was immersed in a water vessel, and its moisture regain was adjusted to 16% by adjusting the squeezing ratio. Printing was performed on this woven fabric in the same manner as in Example 1, and the dyed article was evaluated for clarity and blurring retardation. The evaluation results are given in Table 1.

EXAMPLE 14

A woven fabric of 85% cotton formed by using Egyptian cotton having an average fiber length of 40.6 mm, and 15% of polyester fibers, was immersed in a water vessel, and its moisture regain was adjusted to 20% by adjusting the squeezing ratio. Printing was performed on this woven fabric in the same manner as in Example 1, and the dyed article was evaluated for clarity and blurring retardation. The evaluation results are given in Table 1.

EXAMPLE 15

A georgette cloth of 100% cotton formed by using American raw cotton having an average fiber length of 45 mm was immersed in a water vessel, and its moisture regain was adjusted to 50% by adjusting the squeezing ratio. Printing was performed on this georgette cloth in the same manner as in Example 1, and the dyed article was evaluated for clarity and blurring retardation. The evaluation results are given in Table 1.

EXAMPLE 16

A woven fabric like that of Example 13, of 100% cotton, was immersed beforehand in an aqueous solution of sodium hydroxide having a concentration of 10%, and its moisture regain was adjusted to 20% by adjusting the squeezing ratio.

Printing was performed on this woven fabric in the same manner as in Example 1, and the dyed article was evaluated for clarity and blurring retardation. The evaluation results are given in Table 1.

EXAMPLE 17

A woven fabric like that of Example 13, of 100% cotton, was immersed beforehand in an aqueous solution of thiourea having a concentration of 15%, and its moisture regain was adjusted to 15% by adjusting the squeezing ratio.

Printing was performed on this woven fabric in the same manner as in Example 1, and the dyed article was evaluated for clarity and blurring retardation. The evaluation results are given in Table 1.

EXAMPLES 18 TO 22

The same procedures as those of Examples 13 through 17 were conducted except that inks (H) through (N) were used instead of the inks used in Examples 13 to 17, obtaining the results given in Table 1.

EXAMPLE 23

A woven cloth of Egyptian cotton (100% cotton) having an average fiber thickness of 1.2 d and an average natural convolution of 101/cm was immersed in a water vessel, and its moisture regain was adjusted to 20% by adjusting the squeezing ratio. Printing was performed on this woven fabric in the same manner as in Example 1, and the dyed article was evaluated for clarity and blurring retardation. The evaluation results are given in Table 1.

EXAMPLE 24

A woven cloth of 85% Egyptian cotton having an average fiber thickness of 1.3 d and an average natural twist of 90/cm, and 15% of polyester fibers, was immersed in a water vessel, and its moisture regain was adjusted to 30% by adjusting the squeezing ratio. Printing was performed on this woven fabric in the same manner as in Example 1, and the dyed article was evaluated for clarity and blurring retardation. The evaluation results are given in Table 1.

EXAMPLE 25

A georgette cloth (100% cotton) having an average fiber thickness of 1.0 d and an average natural twist of 110/cm was immersed in a water vessel, and its moisture regain was adjusted to 40% by adjusting the squeezing ratio. Printing was performed on this georgette cloth in the same manner as in Example 1, and the dyed article was evaluated for clarity and blurring retardation. The evaluation results are given in Table 1.

EXAMPLE 26

A woven fabric like that of Example 23, of 100% cotton, was immersed beforehand in an aqueous solution of sodium hydroxide having a concentration of 10%, and its moisture regain was adjusted to 20% by adjusting the squeezing ratio. Printing was performed on this woven fabric in the same manner as in Example 1, and the dyed article was evaluated for clarity and blurring retardation. The evaluation results are given in Table 1.

EXAMPLE 27

A woven fabric like that of Example 23, of 100% cotton, was immersed beforehand in an aqueous solution of thiourea having a concentration of 20%, and its moisture regain was adjusted to 15% by adjusting the squeezing ratio. Printing was performed on this woven fabric in the same manner as in Example 1, and the dyed article was evaluated for clarity and blurring retardation. The evaluation results are given in Table 1.

EXAMPLES 28 TO 32

The same procedures as those of Examples 23 through 27 were conducted except that inks (H) through (N) were used instead of the inks used in Examples 23 to 27, obtaining the results given in Table 1.

COMPARATIVE EXAMPLE 1

A woven fabric of 100% cotton having an average fiber length of 45 mm was immersed in a water vessel, and its moisture regain was adjusted to 6% by drying after adjusting the squeezing ratio to 20%. Printing was performed on this woven fabric in the same manner as in the above examples, using the same ink-jet textile-printing inks (A) to (N) as used in the above examples, and the dyed article was evaluated for clarity and blurring retardation. The evaluation results are given in Table 1.

The densities of the printed articles were lower than those of Example 1, resulting in poorer degree of exhaustion.

COMPARATIVE EXAMPLE 2

A woven fabric of 100% cotton having an average fiber length of 45 mm was immersed in a water vessel, and its moisture regain was adjusted to 110%. Printing was performed on this woven fabric in the same manner as in the above examples, using the same ink-jet textile-printing inks (A) to (N) as used in the above examples, and the dyed article was evaluated for clarity and blurring retardation. The evaluation results are given in Table 1.

The densities of the printed articles were lower than those of Example 1, resulting in poorer degree of exhaustion. Further, problems were also found in terms of conveyance properties and feeding precision.

COMPARATIVE EXAMPLE 3

A woven fabric of 100% cotton, formed by using Egyptian cotton having an average fiber length of 24 mm, was immersed in a water vessel, and its moisture regain was adjusted to 16% by adjusting the squeezing ratio. Printing was performed on this woven fabric in the same manner as in the above examples, using the same ink-jet textile-printing inks (A) to (N) as used in the above examples, and the dyed article was evaluated for clarity and blurring retardation. The evaluation results are given in Table 1.

COMPARATIVE EXAMPLE 4

A woven fabric of 100% cotton, formed by using Egyptian cotton having an average fiber length of 62 mm, was immersed in a water vessel, and its moisture regain was adjusted to 16% by adjusting the squeezing ratio. Printing was performed on this woven fabric in the same manner as in the above examples, using the same ink-jet textile-printing inks (A) to (N) as used in the above examples, and the dyed article was evaluated for clarity and blurring retardation. The evaluation results are given in Table 1.

The densities of the printed articles were lower than those of Example 13, resulting in poorer degree of exhaustion. Further, problems were also found in terms of conveyance properties and feeding precision.

COMPARATIVE EXAMPLE 5

A woven fabric of 100% cotton, formed by using Egyptian cotton having an average fiber thickness of 0.5 d and an average natural twist of 145/cm, was immersed in a water vessel, and its moisture regain was adjusted to 20% by adjusting the squeezing ratio. Printing was performed on this woven fabric in the same manner as in the above examples, using the same ink-jet textile-printing inks (A) to (N) as used in the above examples, and the dyed article was evaluated for clarity and blurring retardation. The evaluation results are given in Table 1.

The densities of the printed articles were lower than those of Example 23, resulting in poorer degree of exhaustion. Further, problems were also found in terms of conveyance properties and feeding precision.

COMPARATIVE EXAMPLE 6

A woven fabric of 100% cotton, formed by using Egyptian cotton having an average fiber thickness of 2.3 d and an average natural twist of 70/cm, was immersed in a water vessel, and its moisture regain was adjusted to 20% by adjusting the squeezing ratio. Printing was performed on this woven fabric in the same manner as in the above examples, using the same ink-jet textile-printing inks (A) to (N) as used in the above examples, and the dyed article was evaluated for clarity and blurring retardation. The evaluation results are given in Table 1.

TABLE 1

| | Examples | | | | | | | | | |
|---|---|---|---|---|---|---|---|---|---|---|
| Evaluation Item | 1 | 2 | 3 | 4 | 5 | 6 | 7 | 8 | 9 | 10 |
| Clarity*1 | o | o | o | o | o | o | o | o | o | o |
| Blurring retardation*2 | o | o | o | o | o | o | o | o | o | o |

| | Examples | | | | | | | | | |
|---|---|---|---|---|---|---|---|---|---|---|
| Evaluation Item | 11 | 12 | 13 | 14 | 15 | 16 | 17 | 18 | 19 | 20 |
| Clarity*1 | o | o | o | o | o | o | o | o | o | o |
| Blurring retardation*2 | o | o | o | o | o | o | o | o | o | o |

TABLE 1-continued

| | Examples | | | | | | | | | |
|---|---|---|---|---|---|---|---|---|---|---|
| Evaluation Item | 21 | 22 | 23 | 24 | 25 | 26 | 27 | 28 | 29 | 30 |
| Clarity*1 | o | o | o | o | o | o | o | o | o | o |
| Blurring retardation*2 | o | o | o | o | o | o | o | o | o | o |

| | Examples | | Comparative Examples | | | | | |
|---|---|---|---|---|---|---|---|---|
| Evaluation Item | 31 | 32 | 1 | 2 | 3 | 4 | 5 | 6 |
| Clarity*1 | o | o | x | x | x | Δ | Δ | x |
| Blurring retardation*2 | o | o | Δ | x | x | Δ | Δ | x |

*1A cloth formed by using American raw cotton was chosen as a standard which had an average fiber length of 45 mm (whose moisture regain was 8.5% in the normal state), and recording was performed on this cloth in the same manner as in the above examples without effecting moisture control. The maximum-absorption-wavelength reflectances of the records obtained were measured, and the average reflectance value thereof was regarded as a unit. Similarly, the maximum-absorption- wavelength reflectances of the records obtained in the above examples were measured, and the average value thereof was obtained for comparison. In the case of blended-yarn fabrics, only the cotton portions thereof were replaced by the above standard cotton. Then, the above measurement was performed on the fabrics to obtain an average reflectance value, which was regarded as a unit.
o: 0.9 or less
Δ: 0.9 to 0.95
x: 0.95 or more
*2Inspection was conducted with the naked eye for any irregularities in the straight-line edges of the records, and a judgment was made as follows:
o: no irregularities
Δ: some irregularities
x: lots of irregularities As described above, it is possible to obtain an article dyed clearly with no ink blurring and with high density with the cloth suitable for ink-jet textile printing of this invention.

The ink-jet textile-printing method of this invention excels in ink fixation and cloth feeding properties, making it possible to efficiently provide excellent dyed articles.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet textile-printing method comprising the steps of:

1) imparting an ink to a cloth, wherein said cloth comprises primarily cellulosic fibers having an average fiber length of 25 to 60 mm, said cloth having a moisture regain of 13.5 to 108.5% by weight;

2) fixing said ink to the cloth; and 3) washing said cloth.

2. An ink-jet textile-printing method according to claim 1, wherein an ink-jet system utilizing heat energy is employed.

3. A printed article produced by the method of claim 1.

4. The method of claim 1, wherein the cloth has an average fiber length of from 30 to 55 mm.

5. The method of claim 1, wherein the cloth has an average fiber length of from 35 to 50 mm.

6. An ink-jet textile-printing method comprising the steps of:

1) imparting an ink to a cloth, wherein said cloth comprises primarily cellulosic fibers having an average fiber thickness of 0.6 to 2.2 denier and an average natural twist of 70 to 150/cm, said cloth having a moisture regain of 13.5 to 108.5% by weight;

2) fixing said ink to the cloth; and 3) washing said cloth.

7. An ink-jet textile-printing method according to claim 6, wherein an ink-jet system utilizing heat energy is employed.

8. The method of claim 6, wherein the cloth has an average fiber thickness of from 0.7 to 2.0 denier.

9. The method of claim 6, wherein the cloth has an average fiber thickness of from 0.8 to 1.8 denier.

10. The method of claim 6, wherein the cloth has an average natural twist of from 80 to 150/cm.

11. The method of claim 6, wherein the cloth has an average natural twist of from 90 to 150/cm.

12. A printed article produced by the method of claim 6.

13. An ink-jet textile-printing method comprising the steps of:

1) imparting an ink to a cloth, wherein said cloth comprises primarily regenerated cellulosic fibers and has a moisture regain of 13.5 to 108.5% by weight;

2) fixing said ink to the cloth; and 3) washing said cloth.

14. An ink-jet textile-printing method according to claim 13, wherein an ink-jet system utilizing heat energy is employed.

15. A printed article produced by the method of claim 13.

16. The method of any one of claims 1, 6 or 13, further comprising imparting an alkaline substance to the cloth, prior to imparting the ink.

17. The method of claim 16, wherein said alkaline substance is imparted to the cloth in an amount of from 0.01 to 5% by weight of the cloth.

18. The method of claim 16, wherein said alkaline substance is a material selected from the group consisting of alkali-metal hydroxides, amines, carbonates or bicarbonates of alkali metals, organic acid metallic salts, ammonia, ammoniates and sodium trichloroacetate.

19. The method of any one of claims 1, 6 or 13, further comprising imparting a substance selected from the group consisting of a water-soluble metallic salt, a water-soluble high molecular weight polymer, urea and thiourea to the cloth, prior to imparting the ink.

20. The method of claim 19, wherein said substance is imparted to the cloth in an amount of from 0.01 to 20% by weight of the cloth.

21. The method of claim 19, wherein said water-soluble metallic salt is a material selected from the group consisting of sodium chloride, sodium sulfate, potassium chloride, sodium acetate, calcium chloride and magnesium chloride.

22. The method of claim 19, wherein said polymer is a material selected from the group consisting of polyvinyl alcohol, polyethylene oxide, acrylic-type water-soluble polymer, maleic-anhydride-type polymer, polysaccharide-type polymer and cellulose-type polymer.

23. The method of any one of claims 1, 6 or 13, wherein the ink contains a reactive dye and an aqueous medium.

24. The method of claim 23, wherein the dye is contained in an amount of 5 to 30% by weight of the ink.

25. The method of any one of claims 1, 6 or 13, wherein the cloth has a moisture regain of from 14.5 to 88.5% by weight.

26. The method of any one of claims 1, 6 or 13, wherein the cloth has a moisture regain of from 15.5 to 68.5% by weight.

* * * * *

UNITED STATES PATENT AND TRADEMARK OFFICE

CERTIFICATE OF CORRECTION

PATENT NO. : 5,645,631

DATED : July 8, 1997

INVENTOR(S) : Koike et al.

It is certified that error appears in the above-identified patent and that said Letters Patent is hereby corrected as shown below:

IN THE TITLE PAGE

[57] ABSTRACT:

Line 1, "ink-Jet" should read --ink-jet--.

IN THE DISCLOSURE

COLUMN 3:

Line 31, "convolution" should read --twist--.

COLUMN 4:

Line 8, "convolution" should read --twist--.

COLUMN 6:

Line 28, "33," should read --33, 45,--.

UNITED STATES PATENT AND TRADEMARK OFFICE

CERTIFICATE OF CORRECTION

PATENT NO. : 5,645,631

DATED : July 8, 1997

INVENTOR(S) : Koike et al.

It is certified that error appears in the above-identified patent and that said Letters Patent is hereby corrected as shown below:

COLUMN 14:

Line 48, "OF" should be deleted.

COLUMN 15:

Line 48, "convolution" should read --twist--.

Signed and Sealed this

Thirty-first Day of March, 1998

*Attest:*

*Attesting Officer*

BRUCE LEHMAN

*Commissioner of Patents and Trademarks*